US011503402B2

(12) United States Patent
Yamagata et al.

(10) Patent No.: US 11,503,402 B2
(45) Date of Patent: Nov. 15, 2022

(54) UNIDIRECTIONAL MICROPHONE

(71) Applicant: HOSIDEN CORPORATION, Osaka (JP)

(72) Inventors: Hiroshi Yamagata, Fukuoka (JP); Hironori Saeki, Fukuoka (JP); Tsuyoshi Baba, Fukuoka (JP); Ryuji Awamura, Fukuoka (JP); Kensuke Nakanishi, Fukuoka (JP)

(73) Assignee: HOSIDEN CORPORATION, Osaka (JP)

( * ) Notice: Subject to any disclaimer, the term of this patent is extended or adjusted under 35 U.S.C. 154(b) by 48 days.

(21) Appl. No.: 17/325,657

(22) Filed: May 20, 2021

(65) Prior Publication Data

US 2021/0400378 A1 Dec. 23, 2021

(30) Foreign Application Priority Data

Jun. 18, 2020 (JP) ..... JP2020-105373

(51) Int. Cl.

| | |
|---|---|
| ***H04R 1/34*** | (2006.01) |
| ***H04R 1/04*** | (2006.01) |
| ***H04R 7/04*** | (2006.01) |
| ***H04R 7/18*** | (2006.01) |
| ***H04R 1/08*** | (2006.01) |

(52) U.S. Cl.

CPC ..... *H04R 1/342* (2013.01); *H04R 1/04* (2013.01); *H04R 1/08* (2013.01); *H04R 7/04* (2013.01); *H04R 7/18* (2013.01)

(58) Field of Classification Search

CPC . H04R 1/342; H04R 1/04; H04R 1/08; H04R 7/04; H04R 7/18; H04R 19/04; H04R 31/00; H04R 1/326

See application file for complete search history.

(56) References Cited

U.S. PATENT DOCUMENTS

| | | | | |
|---|---|---|---|---|
| 2005/0190944 A1* | 9/2005 | Akino | ..... | H04R 1/38 381/369 |
| 2012/0014542 A1* | 1/2012 | Akino | ..... | H04R 1/406 381/174 |
| 2012/0027234 A1* | 2/2012 | Goida | ..... | H04R 1/04 381/150 |

FOREIGN PATENT DOCUMENTS

| | | |
|---|---|---|
| JP | 57-102300 | 6/1982 |

* cited by examiner

*Primary Examiner* — Tuan D Nguyen
(74) *Attorney, Agent, or Firm* — Greenblum & Bernstein, P.L.C.

(57) ABSTRACT

A unidirectional microphone includes: a case having a shape of a bottomed cylinder and including a sound hole in a bottom thereof; a ring-shaped diaphragm fixed to the bottom in the case; a vibrating membrane stretched on the diaphragm; a backplate which has a shape of a bottomed cylinder and is housed in the case in a nested manner such that an air gap to serve as a sound propagation path is formed between the backplate and an inner surface of the case, the backplate including an aperture serving as a sound propagation path in a side face thereof; a spacer positioned between the diaphragm and the backplate to fix the diaphragm and the backplate, and including a notch serving as a sound propagation path in a portion thereof; and a base plate covering a top opening of the case and including a hole serving as a sound propagation path.

13 Claims, 8 Drawing Sheets

*Prior Art*

UNIDIRECTIONAL MICROPHONE

TECHNICAL FIELD

The present invention relates to unidirectional microphones.

BACKGROUND ART

Conventional techniques of condenser microphones include Japanese Utility Model Registration Application Laid Open No. S57-102300, for instance.

While a traditional unidirectional microphone forms acoustic resistance with a gate terminal and a backplate (called a second backplate), the gate terminal is formed of a cut component for achieving minute acoustic resistance, which is a disadvantage in terms of cost.

In addition, it has to employ a divided structure consisting of the backplate (the second backplate), a holder, and a gate ring in order to securely hold the gate terminal and the second backplate, which is also a disadvantage in terms of cost.

SUMMARY OF THE INVENTION

An object of the present invention is therefore to provide a unidirectional microphone having a simple structure and being advantageous in terms of cost.

A unidirectional microphone according to the present invention includes a case, a diaphragm, a vibrating membrane, a backplate, a spacer, and a base plate.

The case has a shape of a bottomed cylinder and includes a sound hole in a bottom thereof. The diaphragm is fixed to the bottom in the case and is ring-shaped. The vibrating membrane is stretched on the diaphragm. The backplate has a shape of a bottomed cylinder and is housed in the case in a nested manner such that an air gap to serve as a sound propagation path is formed between the backplate and an inner surface of the case, and includes an aperture serving as a sound propagation path in a side face thereof. The spacer is positioned between the diaphragm and the backplate to fix the diaphragm and the backplate, and includes a notch serving as a sound propagation path in a portion thereof. The base plate covers a top opening of the case and includes a hole serving as a sound propagation path.

EFFECTS OF THE INVENTION

The unidirectional microphone of the present invention is of a simple structure and advantageous in terms of cost.

DETAILED DESCRIPTION

Figure 1:
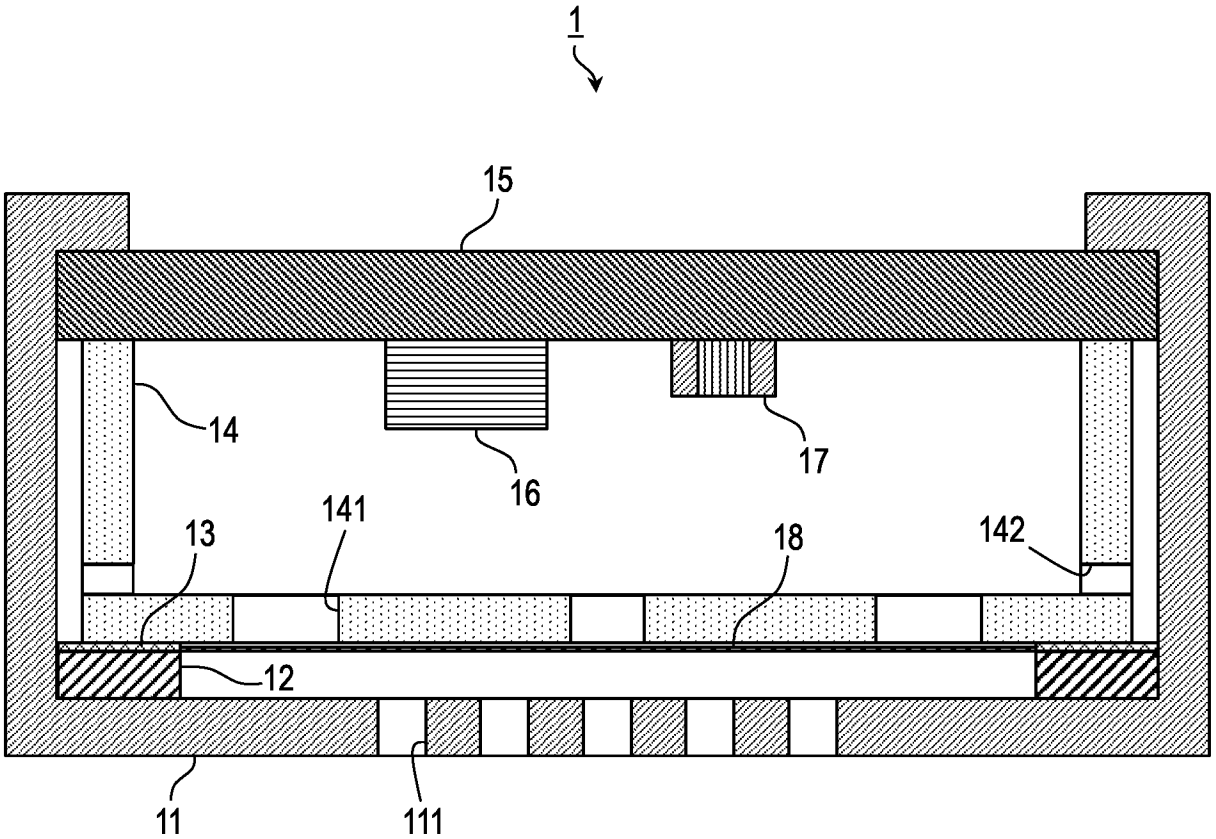
FIG. 1 is a schematic cross-sectional view showing a structure of a conventional omnidirectional microphone.

Embodiments of the present invention are now described in detail. Components with the same functions are given the same reference characters and overlapping descriptions are omitted.

First Embodiment

<Structure of Conventional Omnidirectional Microphone 1>

Referring to FIG. 1, the structure of a conventional omnidirectional microphone 1 is described below. The conventional omnidirectional microphone 1 includes a case 11, a diaphragm 12, spacer 13, a backplate 14 (FEP film welding), a base plate 15, an FET 16, a capacitor 17, and a vibrating membrane 18.

The case 11 has a shape of a bottomed cylinder and includes a sound hole 111 in a bottom thereof. The diaphragm 12 is fixed to the bottom in the case 11 and is ring-shaped. The vibrating membrane 18 is stretched on the diaphragm 12. The backplate 14 has a shape of a bottomed cylinder and is housed in the case 11 in a nested manner, and includes a sound hole 141 serving as sound propagation paths in a bottom thereof and an aperture 142 for inner pressure adjustment in a side face thereof. The spacer 13 is positioned between the diaphragm 12 and the backplate 14 to fix the diaphragm 12 and the backplate 14. The base plate 15 covers a top opening of the case 11.

Unidirectional Microphone 2 According to First Embodiment

A unidirectional microphone 2 according to a first embodiment can achieve unidirectionality just by modifying parts of the structure of the conventional omnidirectional microphone 1 described in FIG. 1. Thus, the number of its components can be similar to that of the omnidirectional microphone 1, which allows a simple structure and is advantageous in terms of cost.

Figure 2:
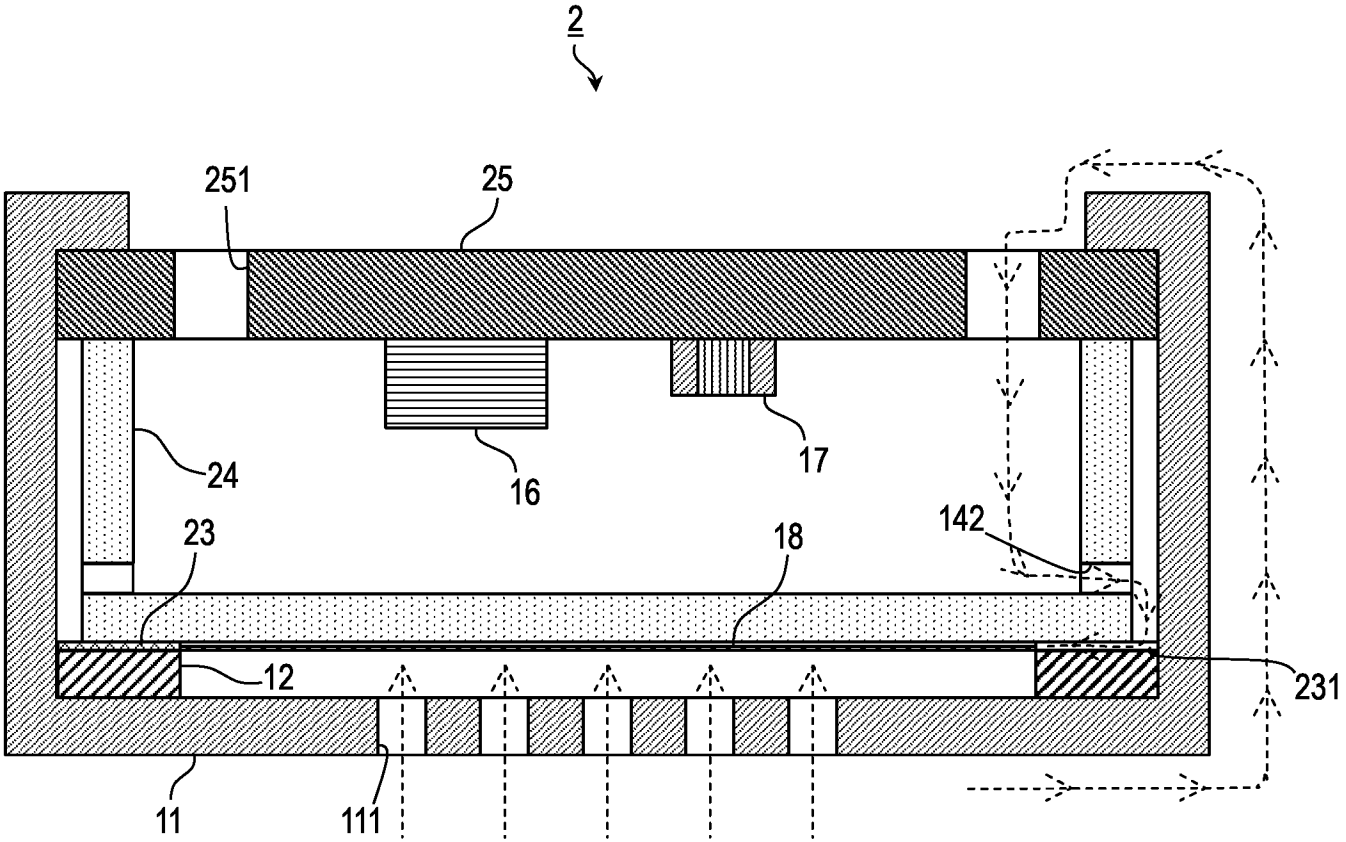
FIG. 2 is a schematic cross-sectional view showing a structure of a unidirectional microphone according to a first embodiment.

Now referring to FIG. 2, the structure of unidirectional microphone 2 according to the first embodiment is described. The unidirectional microphone 2 according to the first embodiment includes the case 11, the diaphragm 12, a spacer 23, a backplate 24 (FEP film welding), a base plate 25, the FET 16, the capacitor 17, and the vibrating membrane 18, and is similar to the conventional omnidirectional microphone 1 except for the spacer 23, the backplate 24, and the base plate 25. In the following, the spacer 23, the backplate 24, and the base plate 25, which are of different structures from those in the conventional omnidirectional microphone 1, are described.

<Spacer 23>

Figure 3B:
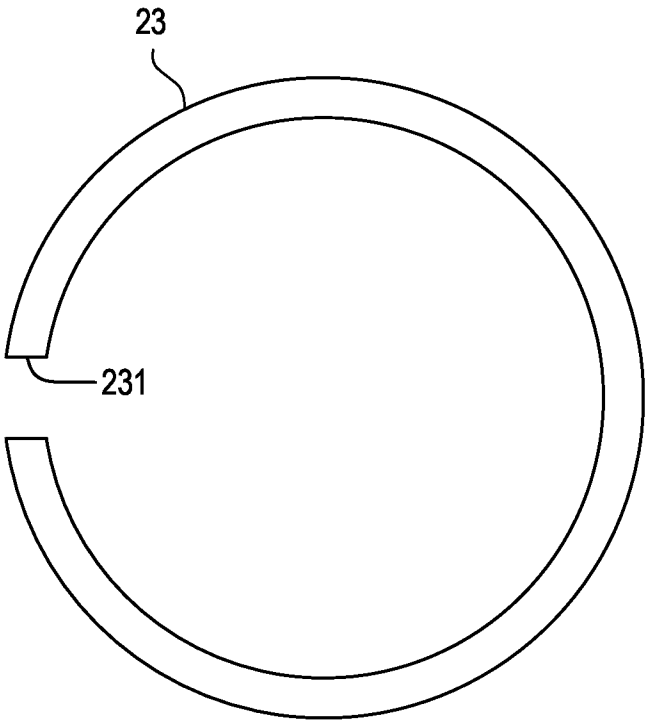
FIG. 3(B) shows a spacer of the unidirectional microphone according to the first embodiment.
Figure 3A:
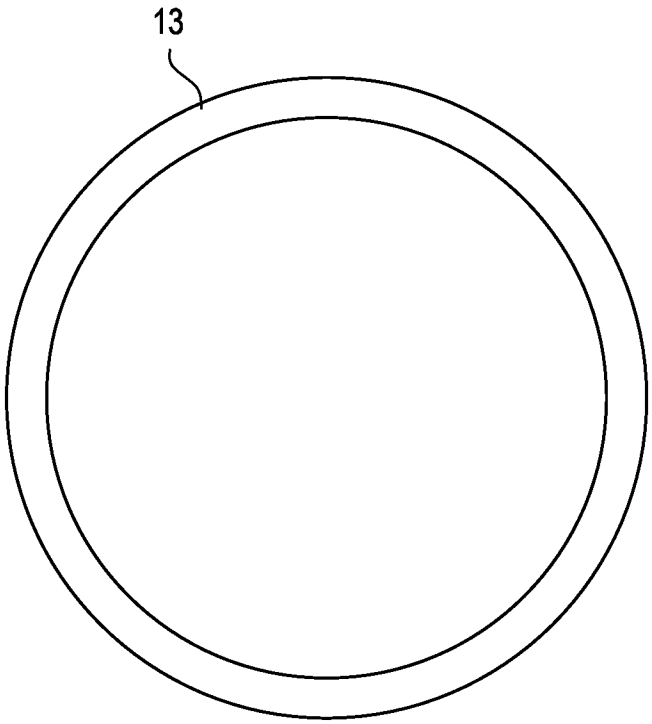
FIG. 3(A) shows a spacer of the conventional omnidirectional microphone.

The spacer 23 is positioned between the diaphragm 12 and the backplate 24 so as to form a certain gap between the diaphragm 12 and the backplate 24, and includes a notch 231 serving as a sound propagation path in a portion thereof. As shown in FIG. 3, the notch 231 is formed (FIG. 3(B)) by cutting away a portion of a periphery of the conventional ring-shaped spacer 13 (FIG. 3(A)). This secures a fine air flow passage.

<Backplate 24>

Figure 4B:
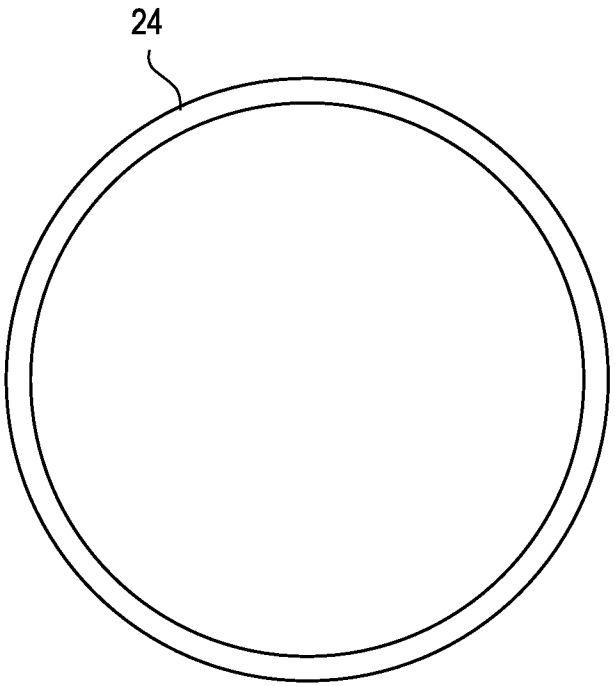
FIG. 4(B) is a schematic plan view of a backplate of the unidirectional microphone according to the first embodiment.
Figure 4A:
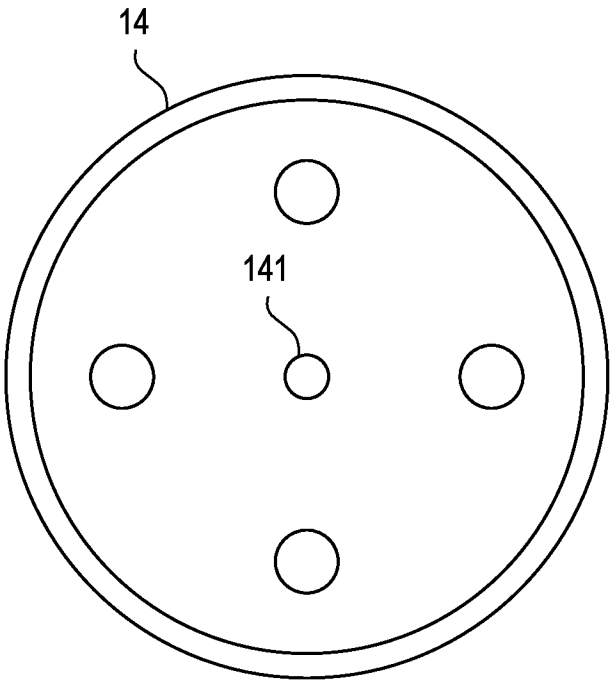
FIG. 4(A) is a schematic plan view of a backplate of the conventional omnidirectional microphone.

The backplate 24 has a shape of a bottomed cylinder and housed in the case 11 in a nested manner such that an air gap to serve as a sound propagation path is formed between the backplate 24 and an inner surface of the case 11, and includes the aperture 142 serving as a sound propagation path in a side face thereof. The sound hole 141 formed in the bottom of the backplate 14 of the conventional omnidirectional microphone 1, shown in FIG. 4(A), is not formed in the backplate 24 (FIG. 4(B)). By eliminating the sound hole 141, passage of air to/from the acoustic resistance side can be blocked.

<Base Plate 25>

The base plate 25 covers the top opening of the case 11 and includes a hole 251 serving as a sound propagation path. In FIG. 2, sound propagation paths are indicated by broken line arrows. As indicated by the broken line arrows, (1) the fine flow passage between the backplate 24 and the case 11 and (2) the notch 231 in the spacer 23 can together form acoustic resistance.

Effects of Unidirectional Microphone 2 of the First Embodiment

A common unidirectional microphone requires an acoustic terminal and/or a gate terminal in order to form acoustic resistance for directivity control. The unidirectional microphone 2 in this embodiment eliminates the need for an acoustic terminal and a gate terminal and enables a simpler structure and reduced cost because the unidirectional microphone 2 introduces acoustic resistance by means of the notch 231 formed by cutting away a portion of the spacer 23 and the gap between the backplate 24 and the case 11.

Further, not providing sound holes in the bottom of the backplate 24 (eliminating the sound hole 141) enables components to be produced by injection molding, which allows reduced cost.

First Modification

Figure 5C:
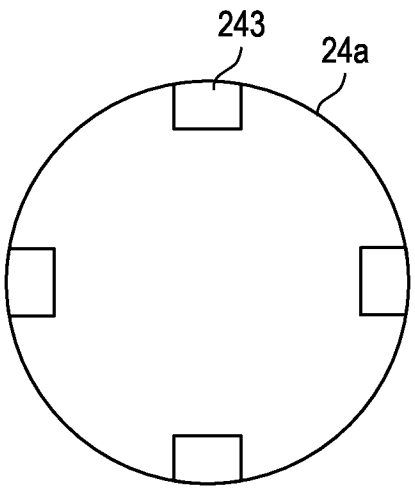
FIG. 5(C) shows a structure of a backplate in a third modification.
Figure 5B:
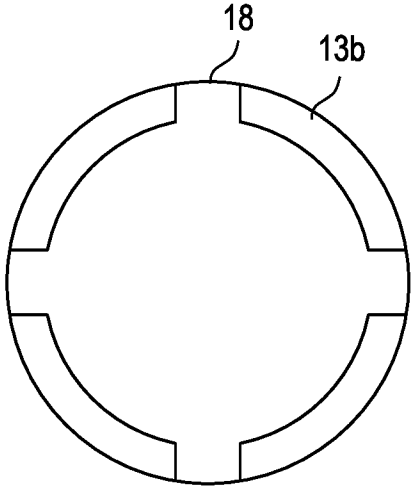
FIG. 5(B) shows a spacer in a second modification.
Figure 5A:
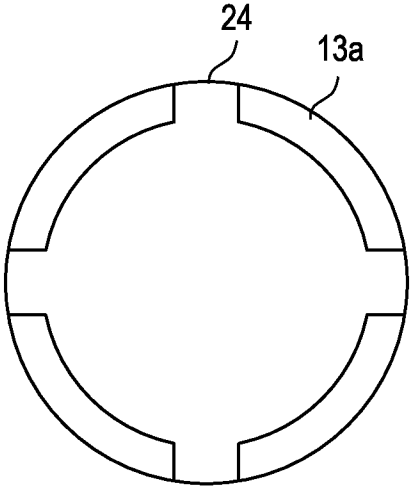
FIG. 5(A) shows a spacer in a first modification.

For example, a spacer 13*a* may be formed by printing on a bottom (underside) of the backplate 24 as shown in FIG. 5(A). Some portions of the periphery of the spacer 13*a* are not printed so that the periphery is discontinuous and these portions act as sound propagation paths. Forming the spacer 13*a* integrally with the backplate 24 enables simplified assembly and reduced cost.

Second Modification

For example, a spacer 13*b* may be formed by printing on a surface of the vibrating membrane 18 as shown in FIG. 5(B). Some portions of the periphery of the spacer 13*b* are not printed so that the periphery is discontinuous and these portions act as sound propagation paths. Forming the spacer 13*b* integrally with the vibrating membrane 18 enables simplified assembly and reduced cost.

Third Modification

For example, the backplate 24 may be replaced with a backplate 24*a* as shown in FIG. 5(C). The backplate 24*a* includes a recess 243 serving as a sound propagation path on the underside of its bottom. The arrangement of the third modification eliminates the need for providing a sound propagation path such as a notch in the spacer 23.

Second Embodiment

Figure 6:
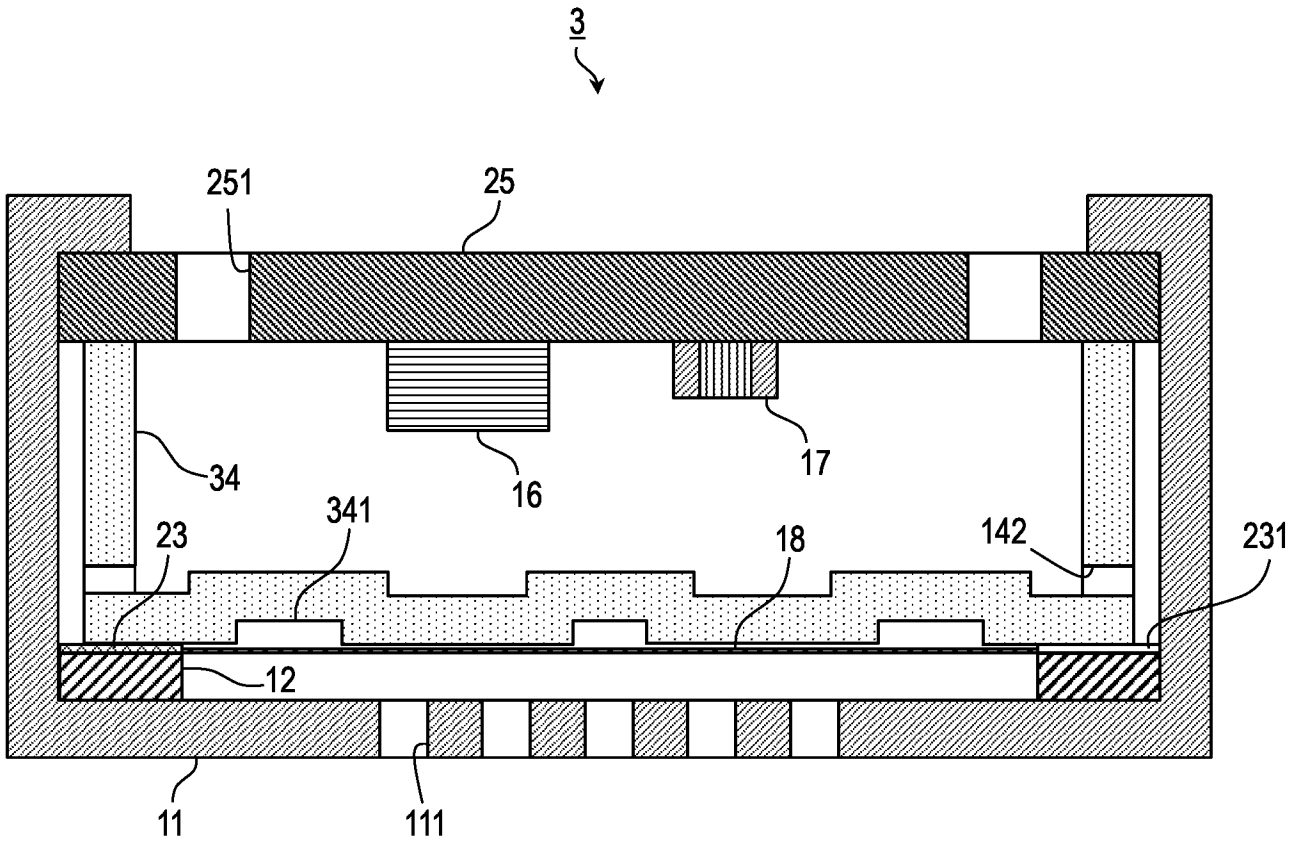
FIG. 6 is a schematic cross-sectional view showing a structure of a unidirectional microphone according to a second embodiment.

Now referring to FIG. 6, the structure of a unidirectional microphone 3 according to a second embodiment is described. The unidirectional microphone 3 according to the second embodiment includes the case 11, the diaphragm 12, the spacer 23, a backplate 34, the base plate 25, the FET 16, the capacitor 17, and the vibrating membrane 18, and is similar to the unidirectional microphone 2 of the first embodiment except for the backplate 34. In the following, the backplate 34, which is of a different structure from that in the unidirectional microphone 2 of the first embodiment, is described.

<Backplate 34>

The backplate 34 includes, on the underside of the bottom of the backplate 34, a dent 341 for increasing the volume of a back chamber, which is a space between the backplate 34 and the vibrating membrane 18.

Effects of Unidirectional Microphone 3 of the Second Embodiment

Sensitivity is increased because the volume of a space above the vibrating membrane 18 (the back chamber) is increased and the resistance of the vibrating membrane 18 is decreased.

Third Embodiment

Figure 7:
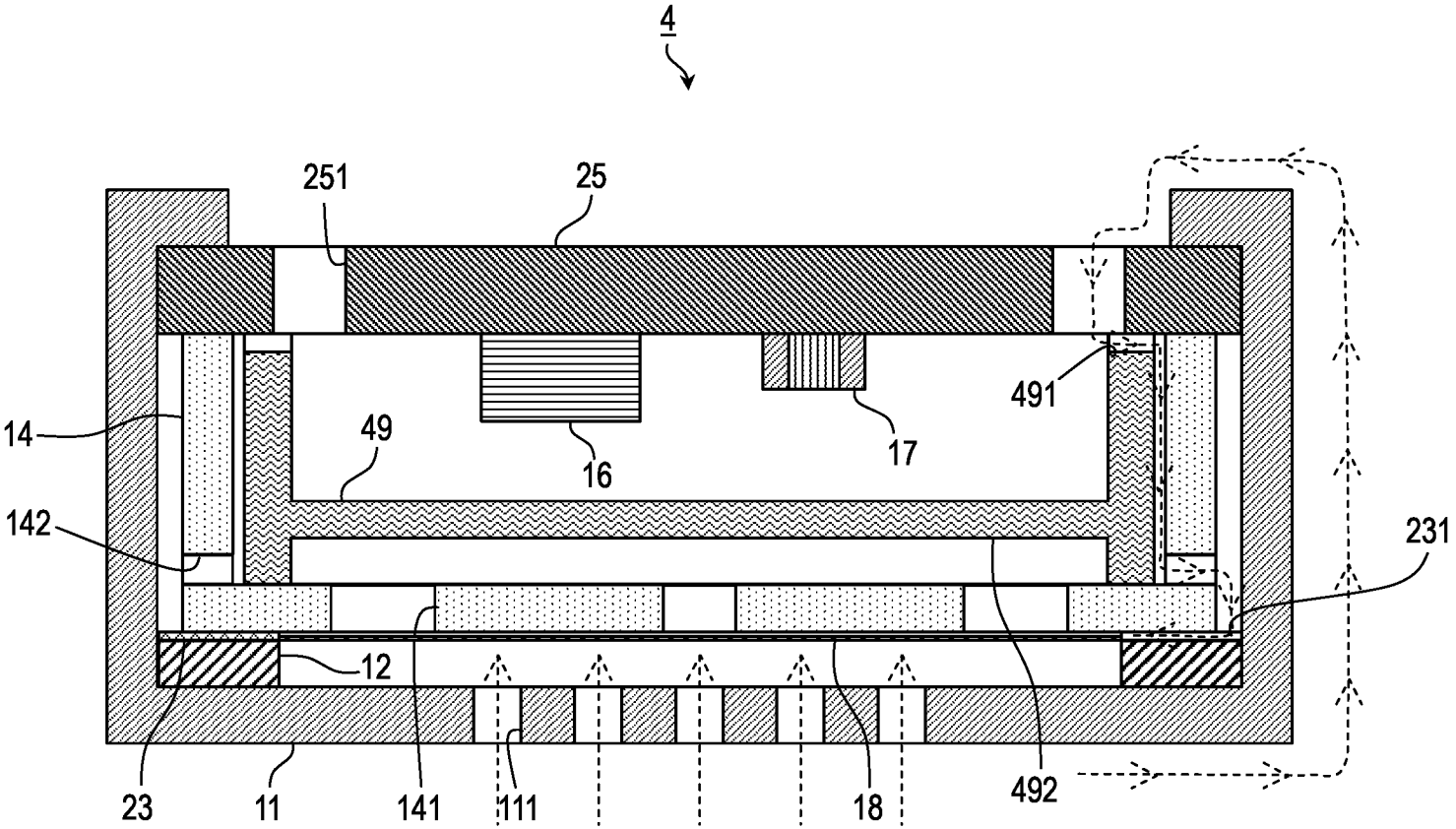
FIG. 7 is a schematic cross-sectional view showing a structure of a unidirectional microphone according to a third embodiment.

Now referring to FIG. 7, the structure of a unidirectional microphone 4 according to a third embodiment is described. The unidirectional microphone 4 according to the third embodiment includes the case 11, the diaphragm 12, the spacer 23, the backplate 14, the base plate 25, the FET 16, the capacitor 17, the vibrating membrane 18, and a gate terminal 49. The unidirectional microphone 4 is different from the unidirectional microphone 2 of the first embodiment in that it uses the backplate 14 similar to the backplate of the conventional omnidirectional microphone 1. It is also different from the unidirectional microphone 2 of the first embodiment in that the gate terminal 49 is added. It is otherwise similar to the unidirectional microphone 2 of the first embodiment. In the following, the gate terminal 49, which is of a different structure from that in the unidirectional microphone 2 of the first embodiment, is described.

<Gate Terminal 49>

As mentioned above, the backplate in the unidirectional microphone 4 of this embodiment is the backplate 14 similar to the backplate of the conventional omnidirectional microphone 1. The backplate 14 includes the sound hole 141 penetrating its bottom.

The gate terminal 49 includes a notch 491 in its side face. This results in a sound propagation path that passes through the hole 251, through the notch 491 in the gate terminal 49, through the gap between the gate terminal 49 and the backplate 14, and through the notch 231 via the aperture 142, and then reaches the vibrating membrane 18. That is, the gate terminal 49 blocks a sound propagation path that runs from the hole 251 in the base plate 25 to the sound hole 141 and that does not go through the aperture 142 in the side face of the backplate 14.

The gate terminal 49 also includes a recess 492 on the backside of its bottom. The recess 492 acts as a back chamber for facilitating the movement of the vibrating membrane 18 (decreasing resistance).

Effects of Unidirectional Microphone 4 of the Third Embodiment

Sensitivity is increased because the volume of the back chamber is increased and the resistance of the vibrating membrane 18 is decreased.

<Frequency Characteristics of Prototypes>

Figure 8:
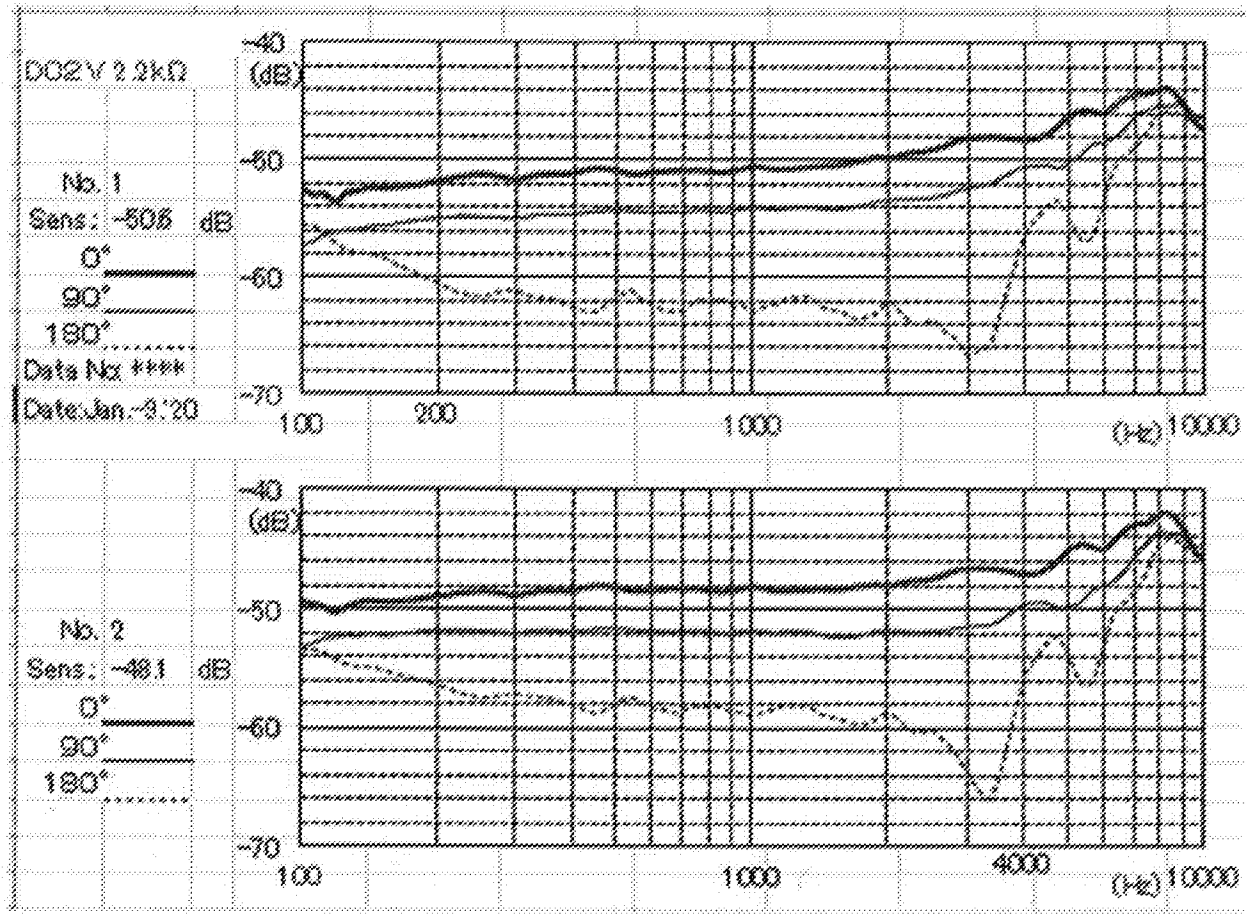
FIG. 8 shows frequency characteristics of two prototypes (No. 1 and No. 2) in the first embodiment.

FIG. 8 shows the frequency characteristics of two prototypes (No. 1 and No. 2). As shown in FIG. 8, it can be seen that a sensitivity difference of 10 dB or higher is secured at sensitivities respectively measured at the angles of 0°/180° for both of the two prototypes (No. 1 and No. 2) and sufficient performance as unidirectional microphones is secured.

The foregoing description of the embodiments of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A unidirectional microphone comprising:

a case having a shape of a bottomed cylinder and including a sound hole in a bottom thereof;

a ring-shaped diaphragm fixed to the bottom in the case;

a vibrating membrane stretched on the diaphragm;

a backplate which has a shape of a bottomed cylinder and is housed in the case in a nested manner such that an air gap to serve as a sound propagation path is formed between the backplate and an inner surface of the case, the backplate including an aperture serving as a sound propagation path in a side face thereof;

a spacer positioned between the diaphragm and the backplate to fix the diaphragm and the backplate, and including a notch serving as a sound propagation path in a portion thereof; and a base plate covering a top opening of the case and including a hole serving as a sound propagation path.

2. The unidirectional microphone according to claim 1, wherein the spacer is formed by printing on an underside of a bottom of the backplate.

3. The unidirectional microphone according to claim 2, comprising:

on the underside of the bottom of the backplate, a dent for increasing a volume of a back chamber, the back chamber being a space between the backplate and the vibrating membrane.

4. The unidirectional microphone according to claim 1, wherein the spacer is formed by printing on a surface of the vibrating membrane.

5. The unidirectional microphone according to claim 4, comprising:

on an underside of a bottom of the backplate, a dent for increasing a volume of a back chamber, the back chamber being a space between the backplate and the vibrating membrane.

6. The unidirectional microphone according to claim 1, comprising:

on an underside of a bottom of the backplate, a dent for increasing a volume of a back chamber, the back chamber being a space between the backplate and the vibrating membrane.

7. The unidirectional microphone according to claim 1, comprising:

a sound hole penetrating a bottom of the backplate; and a gate terminal which blocks a sound propagation path that runs from the hole in the base plate to the sound hole and that does not go through the aperture in the side face of the backplate.

8. A unidirectional microphone comprising:

a case having a shape of a bottomed cylinder and including a sound hole in a bottom thereof;

a ring-shaped diaphragm fixed to the bottom in the case;

a vibrating membrane stretched on the diaphragm;

a backplate which has a shape of a bottomed cylinder and is housed in the case in a nested manner such that an air gap to serve as a sound propagation path is formed between the backplate and an inner surface of the case, the backplate including an aperture serving as a sound propagation path in a side face thereof and including a recess serving as a sound propagation path on an underside of a bottom thereof;

a spacer positioned between the diaphragm and the backplate to fix the diaphragm and the backplate; and a base plate covering a top opening of the case and including a hole serving as a sound propagation path.

9. The unidirectional microphone according to claim 8, wherein the spacer is formed by printing on the underside of the bottom of the backplate.

10. The unidirectional microphone according to claim 9, comprising:

on the underside of the bottom of the backplate, a dent for increasing a volume of a back chamber, the back chamber being a space between the backplate and the vibrating membrane.

11. The unidirectional microphone according to claim 8, wherein the spacer is formed by printing on a surface of the vibrating membrane.

12. The unidirectional microphone according to claim 8, comprising:

on the underside of the bottom of the backplate, a dent for increasing a volume of a back chamber, the back chamber being a space between the backplate and the vibrating membrane.

13. The unidirectional microphone according to claim 8, comprising:

a sound hole penetrating the bottom of the backplate; and a gate terminal which blocks a sound propagation path that runs from the hole in the base plate to the sound hole and that does not go through the aperture in the side face of the backplate.

* * * * *